US008543048B2

(12) United States Patent
Thayer et al.

(10) Patent No.: US 8,543,048 B2
(45) Date of Patent: Sep. 24, 2013

(54) ELECTROPHOTOGRAPHIC MARKING SYSTEM WITH BLADE CUT ANGLES FOR LONGER BLADE LIFE

(75) Inventors: Bruce Earl Thayer, Spencerport, NY (US); Aaron Michael Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 341 days.

(21) Appl. No.: 12/840,757

(22) Filed: Jul. 21, 2010

(65) Prior Publication Data

US 2012/0020712 A1 Jan. 26, 2012

(51) Int. Cl.
*G03G 21/00* (2006.01)

(52) U.S. Cl.
USPC ..... 399/351

(58) Field of Classification Search
USPC ..... 399/351, 350, 355, 327, 273, 283, 399/123, 71
See application file for complete search history.

(56) References Cited

U.S. PATENT DOCUMENTS

| | | | | |
|---|---|---|---|---|
| 3,660,863 | A | 5/1972 | Garbasi | |
| 4,469,434 | A | 9/1984 | Yamazaki et al. | |
| 5,319,431 | A | 6/1994 | Lindblad et al. | |
| 7,620,357 | B2 | 11/2009 | Shakuto et al. | |
| 8,380,116 | B2 * | 2/2013 | Thayer et al. | 399/350 |
| 2007/0003337 | A1 * | 1/2007 | Shakuto et al. | 399/349 |
| 2007/0048049 | A1 * | 3/2007 | Pozniakas et al. | 399/350 |
| 2008/0023168 | A1 | 1/2008 | Conn et al. | |
| 2008/0025775 | A1 * | 1/2008 | Hays et al. | 399/350 |
| 2009/0123205 | A1 * | 5/2009 | Watanabe et al. | 399/350 |
| 2009/0126135 | A1 | 5/2009 | Gilmore et al. | |
| 2010/0034549 | A1 * | 2/2010 | Nakamatsu et al. | 399/71 |
| 2012/0020711 | A1 * | 1/2012 | Thayer et al. | 399/350 |

* cited by examiner

*Primary Examiner* — Walter L Lindsay, Jr.
*Assistant Examiner* — Rodney Bonnette
(74) *Attorney, Agent, or Firm* — Ronald E. Prass, Jr.; Prass LLP

(57) ABSTRACT

According to aspects of the embodiments, there is provided an apparatus comprising a cleaning unit with a blade holder that rotates about a pivot point, the cleaning blade is coupled to the blade holder and is positioned to chisel excess toner from a photoreceptor surface. Geometrical changes produce a blade having a slanted surface that reduces cyclic fatigue stress at the blade tip and reduces blade edge wear. The blade has a sharp leading side, a trailing side, and a working end comprising a slanted surface. When the slanted surface is formed at an angle between 93 degrees to 97 degrees stiffer tips is produced and wears resulting from blade and photoreceptor surface contact is reduced.

14 Claims, 5 Drawing Sheets

| CUT ANGLE, DEG. | LIFE AT 10% FAILURES | LIFE AT 5% FAILURES |
|---|---|---|
| 60 | 706 kc | 303 kc |
| 90 | 351 kc | 276 kc |
| 95 | 1006 kc | 850 kc |
| 100 | 292 kc | 221 kc |

ELECTROPHOTOGRAPHIC MARKING SYSTEM WITH BLADE CUT ANGLES FOR LONGER BLADE LIFE

RELATED APPLICATION

This application is related to the following co-pending applications, each of which is hereby incorporated by reference in its entirety: "Cleaning Edge Modification For Improved Cleaning Blade Life And Reliability", U.S. Ser. No. 12/840,798, filed herewith, by Bruce Thayer et al; "Long Life Cleaning System With Reduced Stress For Start Of Cleaning Blade Operation", U.S. Ser. No. 12/840,729, filed herewith, by Bruce Thayer et al.

BACKGROUND

This disclosure relates in general to copier/printers, and more particularly, to cleaning residual toner from an imaging device surface with cleaning blades and the like that have a unique bevel surface profile to increased blade life and reliability.

In a typical electrophotographic printing process, a photoreceptor or photoconductive member is charged to a uniform potential to sensitize the surface thereof. The charged portion of the photoconductive member is exposed to a light image of an original document being reproduced. Exposure of the charged photoconductive member selectively dissipates the charges thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. Toner particles attracted from the carrier granules to the latent image form a toner powder image on the photoconductive member. The toner powder image is then transferred from the photoconductive member to a copy sheet. Heating of the toner particles permanently affixes the powder image to the copy sheet. After each transfer process, the toner remaining on the photoconductor is cleaned by a cleaning device.

Blade cleaning is a technique for removing toner and debris from a photoreceptor or photoconductive member or other suitable surface within the marking process. In a typical application, a relatively thin elastomeric blade member is supported adjacent to and transversely across the photoreceptor with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. The contacting edge of a cleaning blade has the most influence on blade life and reliability. The bulk of the blade is basically a beam to support the cleaning edge and transmit forces to load the blade against the cleaning surface. The cleaning edge is obviously important for removal of particles from the cleaning surface, but it must also withstand cyclic stresses induced by starts and stops of the cleaning surface and printing/environmental conditions that generate high friction. Success of the blade is determined by how long it retains enough of the original cleaning edge shape to maintain a functional cleaning seal against the cleaning surface. In addition to the stress, photoreceptor surface coatings while improving photoreceptor life typically result in far higher blade wear rates due to friction. Frictional forces cause the blade to stick and slip or chatter as it rubs against the photoreceptor surface. As the blade rubs over the photoreceptor, the blade sticks to the photoreceptor because of static frictional forces. This stick-slip interaction or chatter is a significant cause of blade failure and very disruptive of the printing process. A lubrication film or lubricating particles between the rubbing surfaces reduces the intensity of the stick-slip (chatter) generated by the relative motion, but adverse interactions with other electrophotographic systems may occur.

Cleaning blades are typically designed to operate at either a fixed interference or fixed blade load as disclosed in U.S. Pat. No. 5,208,639 which is included herein by reference. Because of blade relaxation and blade edge wear over time, part and assembly tolerance, and cleaning stresses from environmental conditions and toner input, the cleaning blade is initially loaded to a blade load high enough to provide good cleaning at extreme stress conditions for all of the blade's life. However, a higher than required blade load for nominal stress conditions causes the blade and charge retentive surface to wear more quickly. Overcoated charge retentive surfaces have been developed to reduce the wear rate. While an overcoat protects the charge retentive surface, the overcoats increase the wear rate of the blades due to both physical and chemical interactions.

For the reasons stated above, and for other reasons stated below which will become apparent to those skilled in the art upon reading and understanding the present specification there is need in the art for apparatus, and/or methods that increases the reliability of cleaning blades by changing the geometry of the leading edge of the blade.

SUMMARY

According to aspects of the embodiments, there is provided an apparatus comprising a cleaning unit with a blade holder that rotates about a pivot point, the cleaning blade is coupled to the blade holder and is positioned to chisel excess toner from a photoreceptor surface. Geometrical changes produce a blade having a slanted surface that reduces cyclic fatigue stress at the blade tip and reduces blade edge wear. The blade has a sharp leading side, a trailing side, and a working end comprising a slanted surface. When the slanted surface is formed at an angle, between 93 degrees to 97 degrees, a stiffer tip is produced and wears resulting from blade and photoreceptor surface contact is reduced.

DETAILED DESCRIPTION

Figure 1:
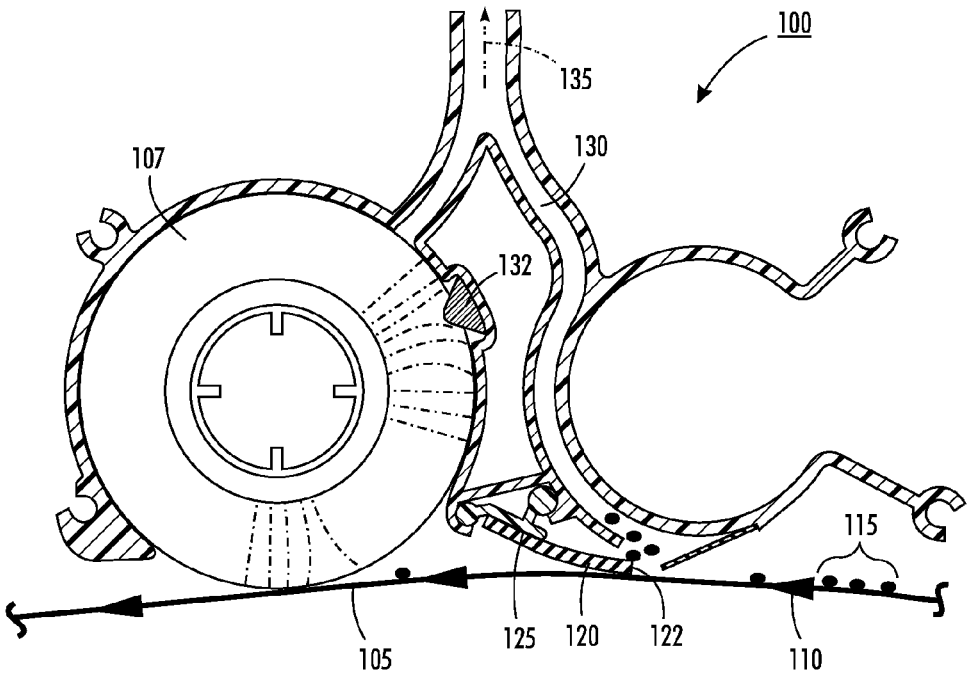
FIG. 1 is an illustration of a marking system using a cleaning brush and the cleaning blade in accordance to an embodiment.

In accordance with various aspects described herein, systems and methods are described that facilitate cleaning a photoreceptor surface in a xerographic imaging device using cleaning blades. In order to greatly reduce blade stress incurred during the cleaning operation blades with at least one slanted surface is formed at angles ranging from 93 degrees to 97 degrees. The slanted surface produces a blade with a stiffer tip. The stiffer tip slows the creation of fatigue cracks, produced from a combination high contact pressure and high wear due to tucking stresses during high friction conditions, which tend to form near the edge of the blade. This narrow cut angle range is optimum for longer blade life and improved blade reliability.

Aspects of the disclosed embodiments relate to a process for producing a cleaning blade with increased blade life and reliability for a printing system comprising selecting a flexible, substantially rectangular, material formed from at least one of cast sheets, molded urethane or elastomer having a first major exterior surface opposite and parallel to a second major exterior surface and a first marginal end region opposite and parallel with a second marginal end region; shaping the first marginal end region at an obtuse angle to form a new sloping surface adjacent to the first major exterior surface and the second major exterior surface, wherein an edge region formed by the sloping surface and the second major exterior surface is capable of engaging a surface to remove particles therefrom; and joining the second marginal end region to a blade holder having a blade positioning mechanism to move the shaped blade into a working position.

In yet another aspect the disclosed embodiments includes an image forming machine comprising a moving surface; a blade with a free end having at least a first plane and a second plane, the first plane being adjacent to the second plane defining an obtuse angle therebetween, the free end further defining a blade tip between the first plane and the second plane; and a blade positioning mechanism connected to the blade to move the blade into a working position wherein the blade tip engages the moving surface to remove particles therefrom; wherein the defined blade tip between the first plane and the second plane reduces blade wear resulting from blade and moving surface contact.

In yet another aspect the disclosed embodiments includes an image forming machine comprising a moving surface; a blade with a free end having at least a first plane and a second plane, the first plane being adjacent to the second plane defining an obtuse angle therebetween, the free end further defining a blade tip between the first plane and the second plane; and a blade positioning mechanism connected to the blade to move the blade into a working position wherein the blade tip engages the moving surface to remove particles therefrom; wherein the defined blade tip between the first plane and the second plane reduces blade wear resulting from blade and moving surface contact.

In still another aspect the image forming machine disclosed embodiments wherein the blade tip comprises a line where the first plane and the second plane meet.

In still another aspect the image forming machine disclosed embodiments wherein the obtuse angle ranges from 93 degrees to 97 degrees.

In still another aspect the image forming machine disclosed embodiments wherein the moving surface is at least one of drum rotating in an operational direction, a flat surface moving in an operational direction, or a belt moving in an operational direction.

In still another aspect the image forming machine disclosed embodiments disclosed embodiments wherein the blade positioning mechanism comprises a supporting member having a rotational axis and being configured to hold the blade.

In still another aspect the image forming machine disclosed embodiments further include a controller to cause the blade positioning mechanism to move the blade within a position to create a minimum blade load so as to remove particles from the moving surface.

In still another aspect the image forming machine disclosed embodiments wherein the moving surface is a drum that rotates in an operational direction and the blade tip extends transversely across the flat surface.

In still another aspect the image forming machine disclosed embodiments wherein the moving surface is a belt moving in an operational direction and the blade tip extends transversely across the belt.

In still another aspect disclosed embodiments includes cleaning station in an electrophotographic marking system, the system comprising in an operative arrangement, a movable photosensitive surface and a cleaning blade in a holder, the blade having a top edge, a bottom edge and an end edge opposite the holder, a blade tip to clean the photosensitive surface, and a bevel on the end edge of the blade that provide lower blade tip wear, wherein the bevel forms an obtuse angle with the bottom edge.

Embodiments as disclosed herein may also include computer-readable media for carrying or having computer-executable instructions or data structures stored thereon for operating such devices as controllers, sensors, and eletromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "print media" generally refers to a usually flexible, sometimes curled, physical sheet of paper, plastic, or other suitable physical print media substrate for images, whether precut or web fed.

The term "image forming machine" as used herein refers to a digital copier or printer, marking system, electrographic printer, electrophotographic printing process, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, electrophotographic printers and copiers that employ dry toner developed on an electrophotographic receiver element.

The term bevel, bevel surface, first plane, sloping surface as used herein refers to the portion of the blade that forms the surface between the leading edge of the blade and the trailing side of the blade and is typically the working surface of the blade when performing cleaning operations.

In FIG. 1, cleaning station or cleaning system 100 of an embodiment, a photoconductive belt 105 is shown as it is adapted to move sequentially first to the cleaning blade 120 and then to an electrostatic brush 107. The cleaning blade 120 typically formed by cutting cast sheets, or molded urethane or other elastomer with a very sharp knife such as a scalpel or the like. The arrows 110 show the direction and path of the photoreceptor belt 105. The blade 120 is therefore upstream from the brush 107 and is the first cleaning component that contacts the belt. In this position, blade 120 may get toner induced lubrication since toner has not been previously removed by a brush 107 or any other component. The electrostatic brush 107 has a charge on it that is opposite to the charge on the toner 115 used in the system. This will permit brush 107 to attract the opposite charged toner 115 and remove any residual toner 115 not removed from the photoreceptor belt 105 by the cleaning blade 120. As noted above, since the cleaning blade 120 is the first cleaning component contacted by the belt 105, there is sufficient toner 115 on the belt at that point to provide ample lubrication for the blade 120 and minimize abrasion of the belt 105. A movable or floating holder 125 for the cleaning blade 120 permits proper movement and support for blade 120 as it contacts photoreceptor belt 105. While any suitable angle of contact between the belt and the blade 105 may be used, an angle of from 5 to 30 degrees has been found to be effective, however, any suitable and effective angle may be used. The electrostatic brush 107 in this particular cleaning station or system 100 follows the blade 120 to remove any residual toner 115. In this cleaning station a vacuum unit 135 is positioned between the blade 120 and brush 107 to vacuum off any loose toner removed by either blade 120 or brush 107. After the toner is vacuumed out it can be disposed of by any suitable method as known to those in the art. Vacuum air channel 130 in air flow contact with the blade 120 and brush 107, respectively. A flicker bar 132 is in operative contact with brush 107 and is adapted to de-tone brush 107 together with vacuum unit 135. As toner 115 is flicked off brush 107 by flicker bar 132, it is picked up by the suction of vacuum channel 130 and transported out of system 100. Flicker bar 132 is positioned such that the fibers in the rotation brush 107 will contact the flicker bar prior to reaching the vacuum channel 130. An entry shield can be located below the cleaning blade 120 to direct loosened toner into vacuum channel 130 for removal from system 100. Toner 115, therefore, is sequentially removed from photoconductor belt 105 by blade 120 which scrapes toner 115 off belt 105 and then by cleaner brush 107 which removes any residual toner by brush action together with electrostatic action. By this continuous contact with the photoconductive belt 105, the blade 120 in the prior art becomes worn and torn at the blade edges which significantly reduces the effective life of the blade. With geometric changes such as with a slanted surface 122, the blade 120 life is significantly increased. Blade 120 can additionally be enhanced with nanotubes fillers to significantly increase the electrical conductivity and thermal conductivity of the blade. This enhanced electrical conductivity can dissipate charge accumulation at the blade 120 due to rubbing against the photoreceptor 105. The enhanced thermal conductivity can aid heat dissipation due to friction at the blade-photoreceptor interface as disclosed in U.S. Pat. No. 7,428,402 which is included herein by reference in its entirety.

Figure 2:
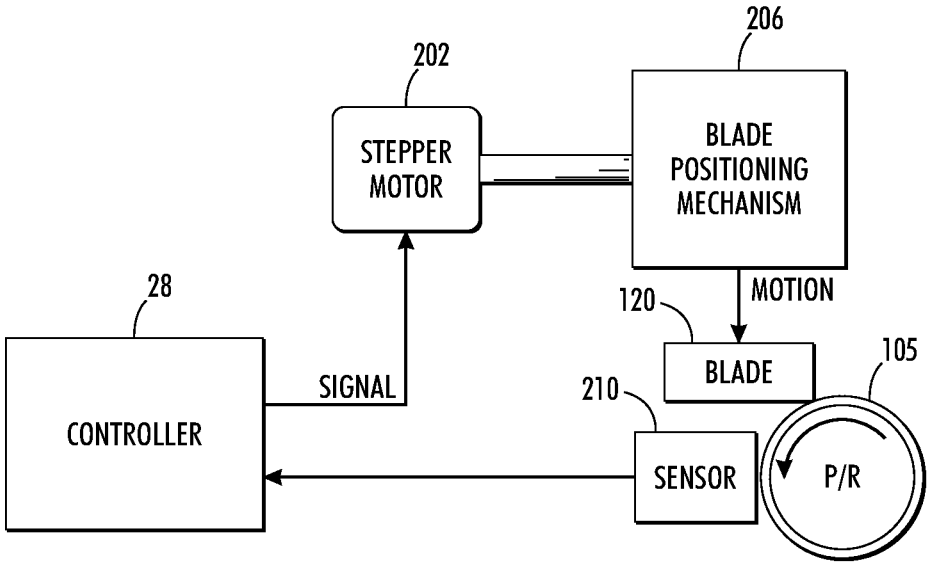
FIG. 2 is a block diagram of controller and blade positioning mechanism used to control blade load in accordance to an embodiment.

FIG. 2 is a schematic of a single stepper motor system used in the cleaning system of FIG. 1 to control blade load 200 in accordance to an embodiment. Rotation of blade 120 through blade positioning mechanism 206, which could be a shaft, two independently driven positioning links, a four bar linkage, cams, guide slots, or other conventional mechanism, controls the amount of interference for the blade in the assembly. By controlling the amount of rotation, the blade load can be varied. The blade holder pivots about a pivot point to position the blade 120 against a moving surface such as a drum rotating in an operational direction, a flat surface moving in an operational direction, or a photoreceptor belt 105 moving in an operational direction, which has a direction of rotation indicated by the arrow at the bottom of photoreceptor belt 105. A stepper motor 202 is used to provide rotation of blade holder 120 in defined increments. A sensor 210 is positioned after cleaner unit (not shown) to provide a detection system that detects the operating cycle for the moving surface. The output from the sensor is input to a controller 28. Controller 28 sends a signal to stepper motor 202 to increase blade interference until a signal sensor 210 indicates a change in the operating cycle. To optimize cleaning blade life, the blade load may be strategically varied at the minimum load for cleaning and to reduce stress experienced at the start and ending of the operating cycle. This will result in the lowest possible wear on the cleaning blade and the photoreceptor while still maintaining good cleaning results.

Figure 3:
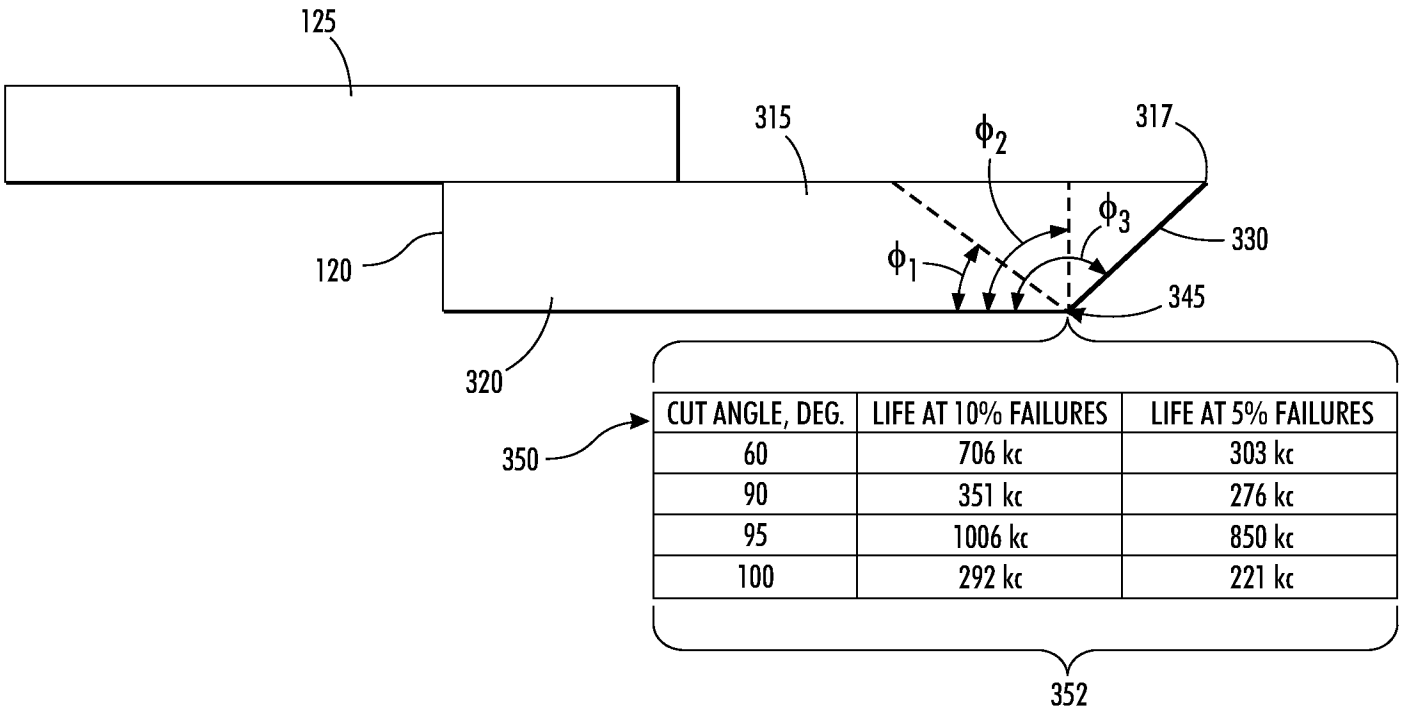
FIG. 3 illustrates blade life and reliability as a function of geometric changes in accordance to an embodiment.

FIG. 3 illustrates blade life and reliability as a function of geometric changes in accordance to an embodiment. The blade 120 comprises a flexible, substantially rectangular, material formed from cast sheets, molded urethane, or molded elastomer having a first major exterior surface 315 opposite and parallel to a second major exterior surface 320 and a free end or first marginal end region opposite and parallel with a second marginal end region that is secured by a holder. The blade 120 has a sharp leading edge 345 and trailing edge 317, as well as a bevel surface 330 as described herein. However, the bevel surface 330 is modified in accordance with the present invention such that the cut angle ($\Phi_1$, $\Phi_2$, $\Phi_3$) is set to a degree where the blade life and reliability is optimized. The holder 125 moves the blade into a working position. The free end of the blade comprises a first plane or bevel surface 330 that forms a blade tip or leading edge 345 with a second plane. The leading side 320 of the blade is parallel to the trailing side 315 of the blade. As shown, the blade 120 is machined such that two surfaces, e.g. 320 and 330, forming a ridge line that contacts the surface to be clean adjoin each other at an obtuse angle such as 95 degrees. The bevel surface and the second plane form part of the blade 120 known as the working end of the blade. The working end of the blade 120 is placed in contact with, or adjacent to, the corresponding piece of a moving surface from which the excess toner, or other material is to be removed.

As seen from table 350 the angle formed between the bevel surface 330 and the second plane 320 correlate to the life and reliability of the blade. Additionally, the table shows that for certain range of angles ($\Phi_1$, $\Phi_2$, $\Phi_3$) such as for acute cut angles ($\Phi_1$), right cut angles ($\Phi_2$), and obtuse cut angles ($\Phi_3$) there are points where the blade life and reliability are maximized. Experiments were conducted with a series of blade cut angles to determine an optimum cut angle for maximum blade life and reliability. The experiments were performed on blade life fixtures. Upon completion of each test, edge wear was measured on the blades. The distributions of blade wear at each cut angle were examined to select the optimum cut angle to minimize blade wear failures.

FIG. 3 shows three views of the measured cut angle and blade wear. Acute cut angle ($\Phi_1$), 70 degrees to 89 degrees, produce very wide distributions of wear rate and very high maximum wear rates. The right cut angle ($\Phi_2$), 90 degrees, also produce wide wear rate distributions and high maximum wear rates. The wide distributions of wear rate especially at the higher end is because acute and right cut angles have a greater tendency to experience, due to increase friction, severe tuck or flip. The tuck or flip generate fatigue cracks that propagate into blade edge tears and generate high wear rates. The most reliable cut angles are the obtuse cut angles ($\Phi_3$), especially in the 93 degrees to 97 degrees range, because they produce a narrow distribution of wear rates and low maximum wear rate. The best results where found to occur at or around the 95 degrees cut angles.

Table 350 shows the projected life distribution of a few blade cut angles at the ten (10) and five (5) percent failure rate as shown in columns labeled 352. Using cumulative probability the 5% and 10% can be transformed to indicate the blade population that should survive to the intended life for the given cut angle. For example, 95% of the blades with a cut angle of 95 degrees are expected to be cleaning satisfactorily at 850 kc. In contrast, 95% of the conventional blade cut angle (90 Degrees) blades would only survive to 276 kc. As a general rule the blade wear rates are converted to blade lives by choosing a blade wear failure threshold value, $Wear_{THRESHOLD}$. The failure threshold can be a predetermined number of prints or cycles or it can be a time period. Blade life is calculated by dividing the wear failure threshold by wear rate (BladeLife=$Wear_{THRESHOLD}$/Wear Rate). Continuing with the tabular information, all of the 95° cut angle blades are expected to last for at least 500 kc in the blade life fixtures. The other cut angle blades (60, 90, and 100 Degrees) shown in Table 350 are expected to have some early blade failures because they all have some portion of their blade wear rate distributions extending to high wear rates. Blades cut at 95 degrees achieve a balance between high wear due to high contact pressure and high wear due to tucking stresses during high friction conditions. This balance results in a narrow cut angle optimum for longer blade life and improved blade reliability.

Figure 4:
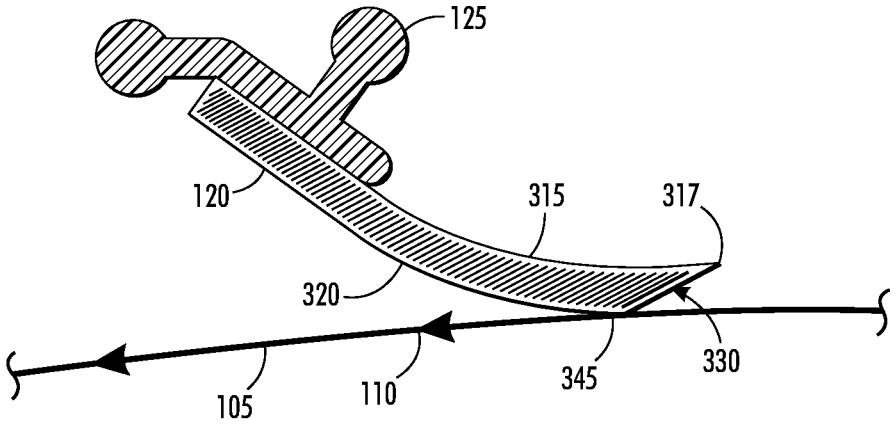
FIG. 4 shows a blade modified with a bevel surface in the process of cleaning a photoreceptor or a photoconductive belt in accordance to an embodiment.

FIG. 4 shows a blade 120 modified with a bevel surface 330 in the process of cleaning a photoreceptor or a photoconductive belt in accordance to an embodiment. The bevel surface 330 is made by shaping a first marginal end region of a material at an obtuse angle to form a new sloping surface 330 adjacent to a first major exterior surface 315 and a second major exterior surface 320, wherein an edge region formed by the sloping surface 330 and the second major exterior surface 320 is capable of engaging a surface such a photoreceptor drum or belt to remove particles therefrom as the surface moves in the direction 110 shown. A movable or floating support 125 for the cleaning blade permits proper movement and support for blade 120 as it contacts photoreceptor belt 105. While any suitable angle of contact between the belt and the blade 105 may be used, an angle of from 5 to 30 degrees has been found to be effective, however, any suitable and effective angle may be used. A geometrically changed blade can be used in the embodiment of FIG. 1 and any other suitable embodiments. Any suitable obtuse angle from 93 degrees to 97 degrees can be selected for the bevel surface while 95 degrees is optimal. The illustration of FIG. 4 is the cleaning station portion where only the cleaning blade 120 is used without cleaning brushes 107. The blade 120 is molded and used in the same embodiment or cleaning system except that in the molded blade has been cut at an obtuse angle to form a blade with the bevel surface 330, leading edge 317, and blade tip 345 that has a stiffer tip with lower tendencies to tuck.

Figure 5:
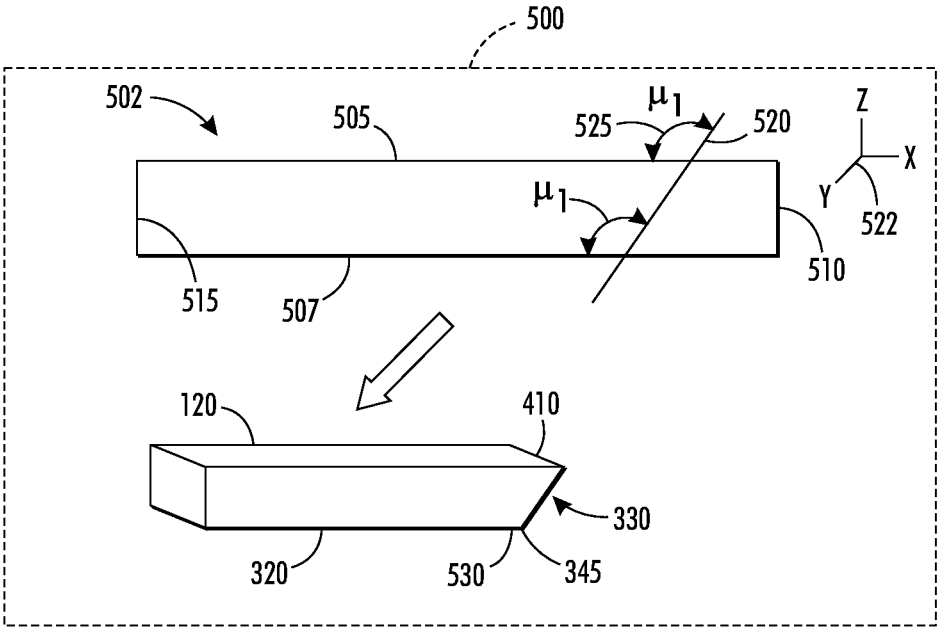
FIG. 5 shows a cross sectional side view of a blade shaped to form a new sloping surface in accordance to an embodiment.

FIG. 5 shows a cross sectional side view 500 of a blade shaped to form a new sloping surface in accordance to an embodiment. The produced cleaning blade has increased reliability and an increased blade life. A flexible, substantially rectangular, material 502 formed from cast sheets, molded urethane or elastomer is selected. The material 502 has a first major exterior surface 505 opposite and parallel to a second major exterior surface 507 and a first marginal end region 510 opposite and parallel with a second marginal end region 515. The substantially rectangular material is cut 520 at an angle 525 (U1) to form a new angled or sloped cross-sectional end like bevel surface 330 that slopes along the Z-Y plane of axis 522. The term cutting is any process that can shape or separate part of material 502 to form a surface having a desired profile. One process is by the conventional use of abrasive media, typically by grinding methods using abrasive stones, wheels, or other abrasive media. Another is to pare material off the surface of the bevel in single or multiple strokes in order to create a working edge or bevel surface. This paring method is known in the art as "skiving." The blade is shaped by cutting 520 the first marginal end region 510 at an obtuse angle 525 to form a new sloping surface adjacent to the first major exterior surface 505 and the second major exterior surface 507. An edge region formed by the sloping surface and the second major exterior surface 507 is capable of engaging a surface to remove particles therefrom. The produced blade 120 has a bevel surface 330 that forms an obtuse angle 530 ranging from 93 degrees to 97 degrees with leading side 320. The intersection of the bevel surface 330 with the leading side forms a blade tip or leading edge 345 that can be used to scrape or rub the debris that may form on a surface.

Figure 6:
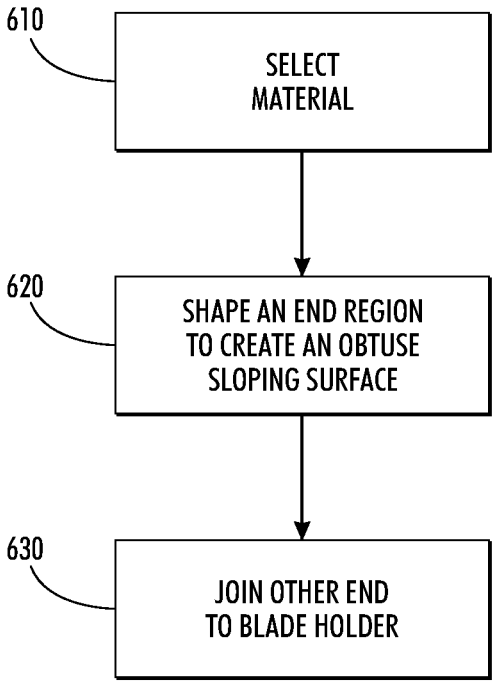
FIG. 6 is a flow chart of a method for producing a cleaning blade with increased blade life and reliability in accordance to an embodiment.

FIG. 6 is a flow chart of a method 600 for producing a cleaning blade with increased blade life and reliability in accordance to an embodiment. Method 600 begins with action 610 where a material is selected to produce a cleaning blade with increased blade life and reliability. The materials for the blade are widely known, usually an elastomer such as rubber, urethanes or other suitably known materials with or without the inclusion of nanotubes that can alter the mechanical properties of the blade. Once the material is selected, an end is shaped 620 to create an obtuse cleaning surface such as a bevel surface. The shaping is the cutting or removing of material of one end region of the selected material following an obtuse angle to form a new sloping surface that starts at one end of a first major exterior surface and finishes at a second major exterior surface. The edge region formed from the shaping defines a blade tip that is at 95 degrees between the sloping surface and a major exterior surface. The blade tip is then used to remove toner and the like from a photoreceptor surface. In action 630 the non-shaped end of the material is attached to a holder that is coupled to a blade positioning mechanism comprises a supporting member having a rotational axis and being configured to hold the blade.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well, or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. An image forming machine comprising:

a moving surface;

a blade held in contact with the moving surface in a counter direction for removing particles on the moving surface and having a free end with at least a first plane defining a working surface and a second plane, the first plane being adjacent to the second plane defining blade cut angle which is greater than 93 degrees and less than 95 degrees between each other to increase blade life and reliability, the free end further defining a blade tip having an edge between the first plane and the second plane and further defining a trailing edge between a third plane and the first plane;

a blade positioning mechanism connected to the blade to move the blade into a working position wherein only the edge of the blade tip engages the moving surface to remove particles therefrom;

a controller to cause the blade positioning mechanism to rotate the blade in defined increments within a position to create a minimum blade load so as to remove particles from the moving surface; and wherein the blade cut angle limits blade edge wear when the blade tip engages the moving surface by reducing tucking stresses.

2. The image forming machine of claim 1, wherein the first plane and the second plane form a ridge line contacting the moving surface.

3. The image forming machine of claim 2, wherein the blade is enhanced with nanotubes fillers to significantly increase the electrical conductivity and thermal conductivity of the blade.

4. The image forming machine of claim 3, wherein the moving surface is at least one of drum rotating in an operational direction, a flat surface moving in an operational direction, or a belt moving in an operational direction.

5. The image forming machine of claim 3, wherein the blade positioning mechanism comprises a supporting member having a rotational axis and being configured to hold the blade.

6. The image forming machine of claim 3, wherein the moving surface is a drum that rotates in an operational direction and the blade tip extends transversely across the drum surface.

7. The image forming machine of claim 3, wherein the moving surface is a belt moving in an operational direction and the blade tip extends transversely across the belt.

8. A cleaning station in an electrophotographic marking system, the system comprising in an operative arrangement, a movable surface and a cleaning blade in a holder, the blade having a top edge, a bottom edge and an end edge opposite the holder, a blade tip to clean the movable surface, and a bevel defining a working surface on the end edge of the blade that provide lower blade tip wear, wherein the bevel forms a blade cut angle which is greater than 93 degrees and less than 95 degrees with the bottom edge to increase blade life and reliability and further defining a trailing edge with the top edge; and a controller to cause the blade positioning mechanism to rotate the blade in defined increments within a position to create a minimum blade load so as to remove particles from the moving surface;

wherein the blade cut angle limits blade edge wear when the blade tip engages the movable surface by reducing tucking stresses.

9. The cleaning station of claim 8, wherein the blade tip comprises a ridge line where the bottom edge and the end edge meet.

10. The cleaning station of claim 9, wherein the blade is enhanced with nanotubes fillers to significantly increase the electrical conductivity and thermal conductivity of the blade.

11. The cleaning station of claim 10, wherein the movable surface is at least one of drum rotating in an operational direction, a flat surface moving in an operational direction, or a belt moving in an operational direction.

12. The cleaning station of claim 10, wherein the holder is coupled to a blade positioning mechanism that comprises a supporting member having a rotational axis and being configured to hold the blade.

13. The cleaning station of claim 10, wherein the surface is a drum rotating in an operational direction and the blade tip extends transversely across the drum surface to remove debris during a cleaning operation.

14. The cleaning station of claim 10, wherein the surface is a belt moving in an operational direction and the blade tip extends transversely across the belt to remove debris from the belt during a cleaning operation.

* * * * *